US006053146A

United States Patent [19]

Arlton et al.

[11] Patent Number: 6,053,146

[45] Date of Patent: Apr. 25, 2000

[54] MODEL AIRCRAFT ENGINE WITH EXHAUST CONTROL MECHANISM

[75] Inventors: Paul E. Arlton, 1132 Anthrop Dr., West Lafayette, Ind. 47906; Paul Klusman, Lafayette, Ind.

[73] Assignee: Paul E. Arlton, West Lafayette, Ind.

[21] Appl. No.: 09/284,665

[22] PCT Filed: Oct. 16, 1997

[86] PCT No.: PCT/US97/18602

§ 371 Date: Apr. 16, 1999

§ 102(e) Date: Apr. 16, 1999

[87] PCT Pub. No.: WO98/16729

PCT Pub. Date: Apr. 23, 1998

Related U.S. Application Data

[60] Provisional application No. 60/028,590, Oct. 16, 1996.

[51] Int. Cl.[7] ..... F02D 9/04; F02D 9/14

[52] U.S. Cl. ..... 123/323; 123/DIG. 3; 29/888.01; 188/273

[58] Field of Search ..... 123/323, DIG. 3; 188/273; 60/324; 29/888.01

[56] References Cited

U.S. PATENT DOCUMENTS

| | | | |
|---|---|---|---|
| 2,806,458 | 7/1957 | Mettetal | 123/DIG. 3 |
| 3,002,506 | 10/1961 | Mocarski | 123/DIG. 3 |
| 4,321,893 | 3/1982 | Yamamoto | 123/65 PE |
| 4,341,188 | 7/1982 | Nerstrom | 123/323 |
| 4,669,585 | 6/1987 | Harris | 188/273 |
| 4,903,802 | 2/1990 | Takigawa et al. | 188/273 |

FOREIGN PATENT DOCUMENTS

| | | | |
|---|---|---|---|
| 1 153 208 | 8/1963 | Germany | 123/323 |

OTHER PUBLICATIONS

Cox™ Muffler As Modified By John Molnar (photograph).

*Primary Examiner*—Andrew M. Dolinar
*Attorney, Agent, or Firm*—Barnes & Thornburg

[57] ABSTRACT

An exhaust control mechanism is provided for use in a model engine system having a source of engine exhaust. The exhaust control mechanism includes first and second tubes and a valve movable in one of the first and second tubes. The first tube includes an upper portion, a lower portion, and a first passage extending through the upper portion and lower portion. The upper portion of the first tube is adapted to couple to a source of engine exhaust. The second tube is coupled to the first tube and the second tube is formed to include a second passage that intersects the first passage formed in the first tube at an intersection region. The valve is movable in one of the first and second tubes to extend into the intersection region.

38 Claims, 12 Drawing Sheets

FIG. 4
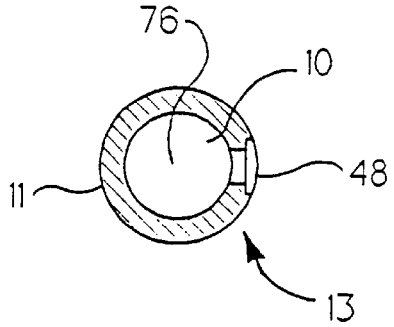
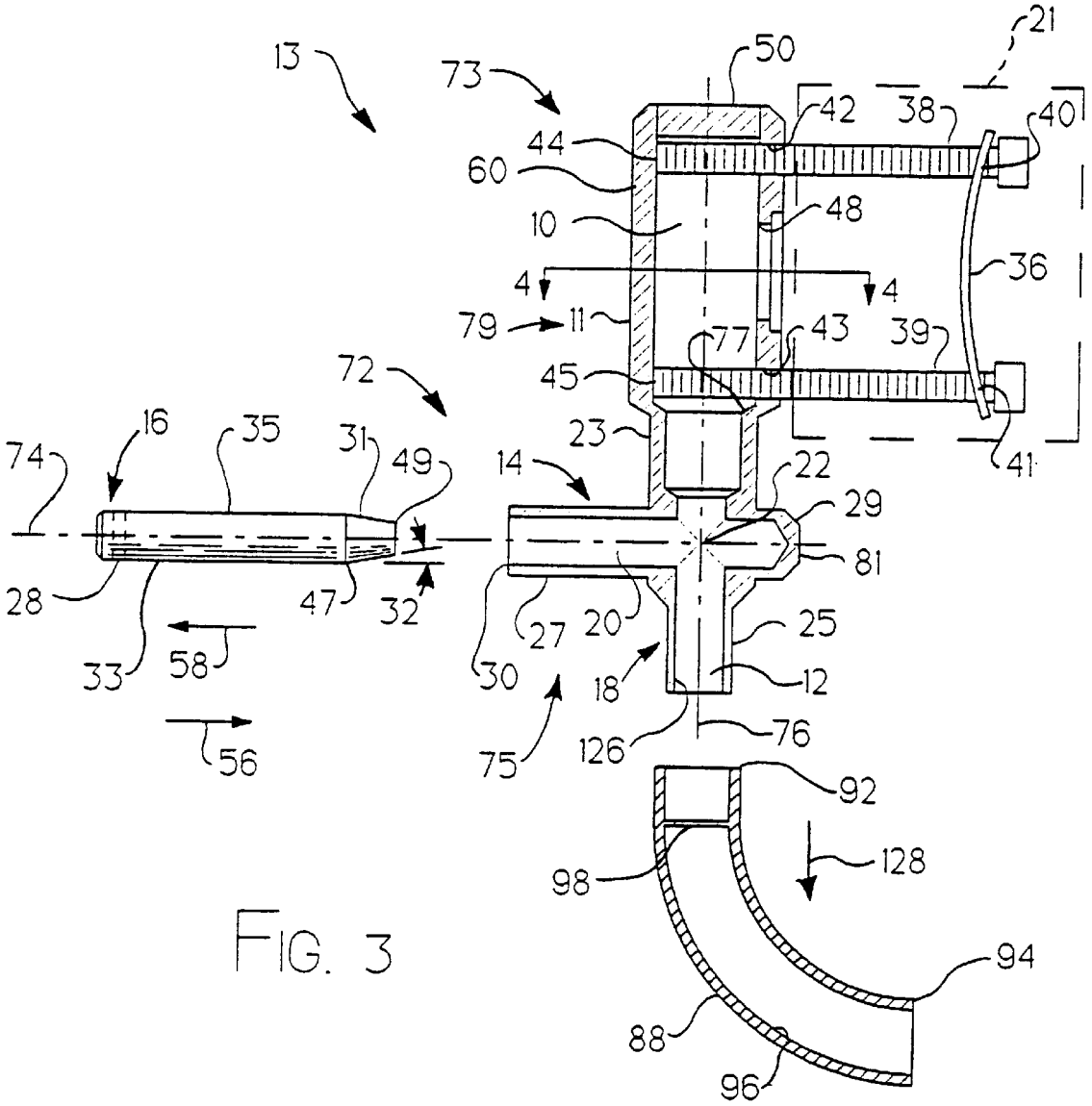
FIG. 3

MODEL AIRCRAFT ENGINE WITH EXHAUST CONTROL MECHANISM

CROSS-REFERENCE TO RELATED APPLICATIONS

This application is a U.S. national application of international application Ser. No. PCT/US97/18602 filed Oct. 16, 1997, which claims priority to U.S. provisional appliation Ser. No. 60/028,590 filed Oct. 16, 1996.

BACKGROUND AND SUMMARY OF THE INVENTION

This invention relates to engines for model aircraft, and particularly, to exhaust control systems for model aircraft engines. More particularly, the present invention relates to throttle and muffler systems for use with model aircraft engines in small radio-controlled model helicopters.

Model aircraft engines typically include a carburetor for mixing air and fuel, an ignition source (e.g., a glow plug), a piston cylinder where the air and fuel are combusted, and an engine exhaust port where engine exhaust from the combusted air and fuel exits the model aircraft engine. Sometimes a muffler is provided to quiet the exhaust gas produced by the model aircraft engine.

A throttle is provided on some model aircraft engines so that a pilot may operate the model aircraft engines at more than one speed. As the model aircraft engine changes speed, the power produced by the model aircraft engine also changes. Adjusting the throttle of the model aircraft engine adjusts the power produced by the model aircraft engine so that the speed at which the helicopter climbs and/or travels may be changed. Throttles are generally situated adjacent to the model aircraft engine inlet to restrict the amount of air entering the carburetor or situated adjacent to the engine exhaust port of the model aircraft engine to restrict the amount of air exiting the engine exhaust port.

The operating speed of most modern throttled model aircraft engines is adjusted by restricting the amount of air entering the carburetor. The primary function of the carburetor, however, is to mix air and fuel. Thus, adding a throttle to the carburetor makes the carburetor considerably more complex. Carburetor-type throttles are also relatively bulky and expensive.

Model aircraft engines can also be throttled by means of a conventional exhaust restrictor throttle mechanism. Exhaust restrictor throttle mechanisms throttle model aircraft engines by restricting the flow of exhaust gas out of engine exhaust ports formed in the model aircraft engine. This method of throttling is particularly advantageous for model aircraft engines including glow plugs because heat is retained within the model aircraft engine piston cylinder to keep the glow plug element hot. In addition, restricting the engine exhaust port also reduces the noise level of exhaust gases exiting the engine. Exhaust restrictor throttles tend to muffle engine noise when engine speed is low, as would be expected on a model helicopter when hovering a few feet above the ground.

Typically, conventional exhaust restrictor throttle mechanisms are of the rotary valve type and are situated immediately adjacent to the model aircraft engine exhaust port. Not only does the exhaust restrictor throttle valve in this location become extremely hot, but the choice and orientation of exhaust restrictor throttle valve configurations is limited by the proximity of the model aircraft engine to a valve-actuation mechanism which actuates the exhaust restrictor throttle valve.

Engine throttling is an important function for the proper operation of model helicopters. While a great deal of interest for flying model helicopters exists in the modeling community, radio-controlled model helicopters are typically expensive and complicated. Only a very small percentage of modelers can actually afford to buy a helicopter and fewer modelers are skillful enough to build and fly a model helicopter successfully.

Recent advances in the art of small radio-controlled model helicopters have resulted in a new class of improved small model helicopters that are simple and inexpensive enough to appeal to a wide modeling audience. New features that are incorporated into this new class of improved small model helicopters to simplify and/or reduce the expense of radio-controlled model helicopters and increase the availability of model helicopters to a wider, less sophisticated audience are disclosed, for example, in U.S. Pat. Nos. 5,305,968 to Paul E. Arlton, 5,597,138 to Paul E. Arlton and David J. Arlton, 5,628,620 to Paul E. Arlton, and 5,609,312 to Paul E. Arlton and David J. Arlton, U.S. patent application Ser. Nos. 08/687,649 by Paul E. Arlton, 08/729,184 by Paul E. Arlton and David J. Arlton, 08/728,929 by Paul E. Arlton, David J. Arlton, and Paul Klusman, 08/814,943 by Paul E. Arlton, and 08/855,202 by Paul E. Arlton and David J. Arlton, and U.S. Provisional Patent Application No. 60/028590 by Paul E. Arlton and Paul Klusman.

Effective speed control of the model aircraft engines for this new class of small model helicopters is problematic, however, because most small model aircraft engines lack throttles. While conventionally throttled model aircraft engines are currently available, these conventional model aircraft engines are typically too large, heavy, powerful, or expensive for the new small radio-controlled model helicopters. Without a throttle, the model aircraft engine provided in most small model aircraft can operate at only one speed.

One type of small model aircraft engine (a Cox™ 0.051 engine) currently used on small model helicopters has an exhaust restricting sleeve appended to the piston cylinder to block the exhaust ports and throttle the model aircraft engine. This Cox™ model aircraft engine does not include a muffler which makes this model aircraft engine relatively loud and annoying. In addition, this Cox™ model aircraft engine does not include a proper exhaust stack to direct oily engine exhaust away from the helicopter which makes the Cox™ model aircraft engine messy.

What is needed is a simple, effective mechanism to control the speed of, quiet the exhaust gas produced by, and direct the exhaust gas away from a model aircraft engine for use on small model helicopters. Model helicopter pilots would greatly appreciate a quieter, cleaner, speed-controlled model aircraft engine for use on a small model helicopter.

According to the present invention, an exhaust control mechanism is provided for use in a model engine system having a source of engine exhaust. The exhaust control mechanism includes first and second tubes and a valve movable in one of the first and second tubes. The first tube includes an upper portion, a lower portion, and a first passage extending through the upper portion and lower portion. The upper portion of the first tube is adapted to couple to a source of engine exhaust. The second tube is coupled to the first tube and the second tube is formed to include a second passage that intersects the first passage formed in the first tube at an intersection region. The valve is movable in one of the first and second tubes to extend into the intersection region.

The exhaust control mechanism combines a throttle with an exhaust control member body to control the speed of a model aircraft engine by restricting the passage of exhaust gasses from exhaust ports of the model aircraft engine, quiet the exhaust gasses as they exit the model aircraft engine, and direct the exhaust gasses away from the model aircraft engine. The present invention also provides means for actuating the throttle without introducing a bellcrank into a throttle control linkage extending between the throttle and a throttle servo.

More specifically, the muffler of the exhaust control mechanism includes a chamber body formed to include an exhaust collection chamber communicating with the exhaust ports of the model aircraft engine. In a preferred embodiment, the exhaust collection chamber is sized to operate as an expansion-type muffler. Exhaust gasses produced by the model aircraft engine collect in the exhaust collection chamber and then exit the exhaust collection chamber through an exhaust passage formed in one of the first and second tubes.

The throttle includes an exhaust-restricting mechanism that is movable through a passage formed in one of the first and second tubes and a portion of the other tube to restrict the flow of exhaust gasses through the exhaust control member body thereby controlling the speed and power of the model aircraft engine. In a preferred embodiment, the exhaust-restricting mechanism includes a simple slide valve that translates through the first and second passages. This slide valve includes only one moving part and is oriented to translate through one of the first and second passages inline with the throttle control linkage for simple side-operation of the exhaust-restricting mechanism.

In another alternative embodiment of the present invention, the slide valve may be replaced with a rotary valve, but with the disadvantage of increased part-count. Advantageously, with both slide valve orientations and types of valves, the tube through which exhaust gas flows is unobstructed and extendible (as with silicone tubing) so that exhaust gasses can be routed away from the model aircraft engine and aircraft.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 3 is a cross-sectional view of the muffler and exhaust control mechanism shown in FIGS. 1 and 2 and a curved exhaust extension, the muffler having a chamber body defining an exhaust collection chamber and the exhaust control member body including a vertical exhaust tube formed to include an exhaust passage that extends along a shared axis with the chamber body to connect to the curved exhaust extension and a horizontal throttle tube connected to the muffler and formed to include a throttle passage, the throttle of the exhaust control mechanism having a slide valve sized to extend into the throttle passage;

FIG. 4 is a sectional view taken along line 4—4 of FIG. 3 showing an exhaust-receiving aperture formed in the chamber body of the muffler;

DETAILED DESCRIPTION OF THE DRAWINGS

Figure 1:
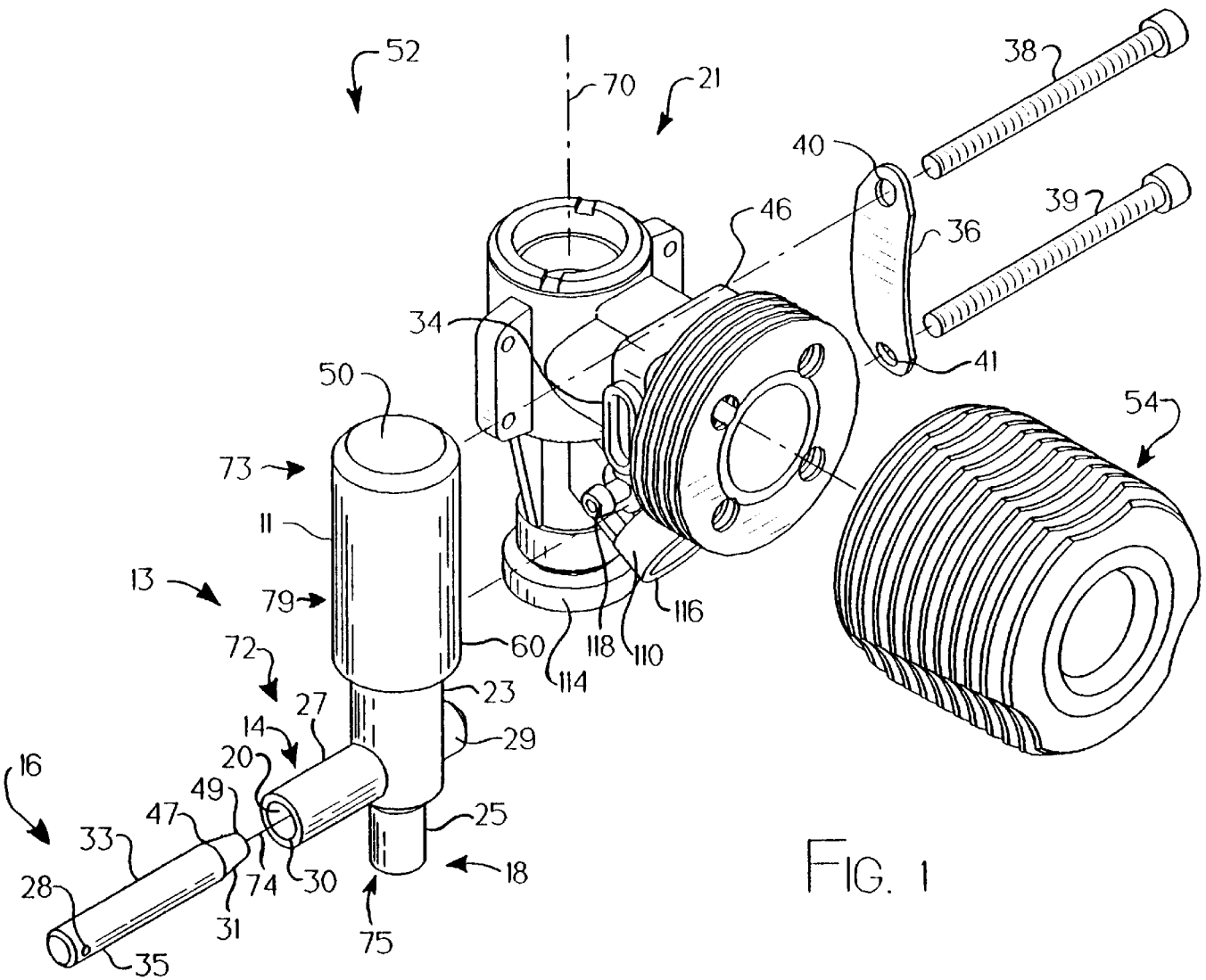
FIG. 1 is a perspective exploded view of a model aircraft engine system in accordance with the present invention including a model aircraft engine, a heat sink, a muffler, and a muffler strap used to connect the model aircraft engine and muffler, and an exhaust control mechanism including an exhaust control member body and a throttle.

A model aircraft engine system 52 according to the present invention is shown in FIG. 1. The model aircraft engine system 52 includes a model aircraft engine 21, a heat sink 54, an exhaust control mechanism 13, a muffler 73, and a muffler strap 36. The muffler strap 36 and bolts 38, 39 connect muffler 73 to model aircraft engine 21.

Exhaust control mechanism 13 controls the speed and power of model aircraft engine 21 by restricting the flow the exhaust gas leaving muffler 73. Exhaust control mechanism 13 includes a throttle 72 and an exhaust control member body 75 as shown in FIGS. 1–5. Exhaust control member body 75 includes first and second tubes 14, 18 that are formed to include first and second passages 20, 12, respectively. First and second passages 20, 12 intersect at an intersection region 22. Throttle 72 includes a slide valve 16 that is slidable through second tube 14 into intersection region 22.

Muffler 73 quiets the noise of exhaust gas exiting model aircraft engine 21. Muffler 73 is connected to model aircraft engine 21 and exhaust control mechanism 13 as shown in FIGS. 1–5. Throttle 72 of exhaust control mechanism 13 controls the speed and power of model aircraft engine 21 by controlling the flow of exhaust gas exiting model aircraft engine 21 through muffler 73 and exhaust control member body 75.

In a presently preferred embodiment, model aircraft engine 21 is a Vmax6™ brand model aircraft engine distributed by Norvell Corp. of Twinsburg, Ohio. Model aircraft engine 21 runs on a 15% nitromethane model aircraft engine fuel. Model aircraft engine 21 includes a carburetor 110, a crankcase 112, a crankshaft 114 rotatable about a vertical engine axis 70, and an engine cylinder 46 as shown, for example, in FIGS. 1 and 7. Carburetor 110 includes a carburetor intake 116 through which air enters into carburetor 110 and a needle valve 118 to control the amount of aircraft engine fuel entering carburetor 110. Engine cylinder 46 is formed to include an engine exhaust port 34 as shown in FIG. 1. The exhaust gasses produced by model aircraft engine 21 exit model aircraft engine 21 through engine exhaust port 34. Model aircraft engine 21, and more specifically engine exhaust port 34 formed in model aircraft engine 21 can are referred to as a source of engine exhaust.

Engine speed as used herein is the rate of rotation of the crankshaft 114 about vertical engine axis 70. Engine speed can be expressed in units such as revolutions per minute (rpm). Engine power as used herein is the rate of rotation of crankshaft 114 about vertical engine axis 70 multiplied by the torque produced by crankshaft 114. Engine power can be expressed in units such as watts, horsepower, or foot-pound/second.

Figure 5:
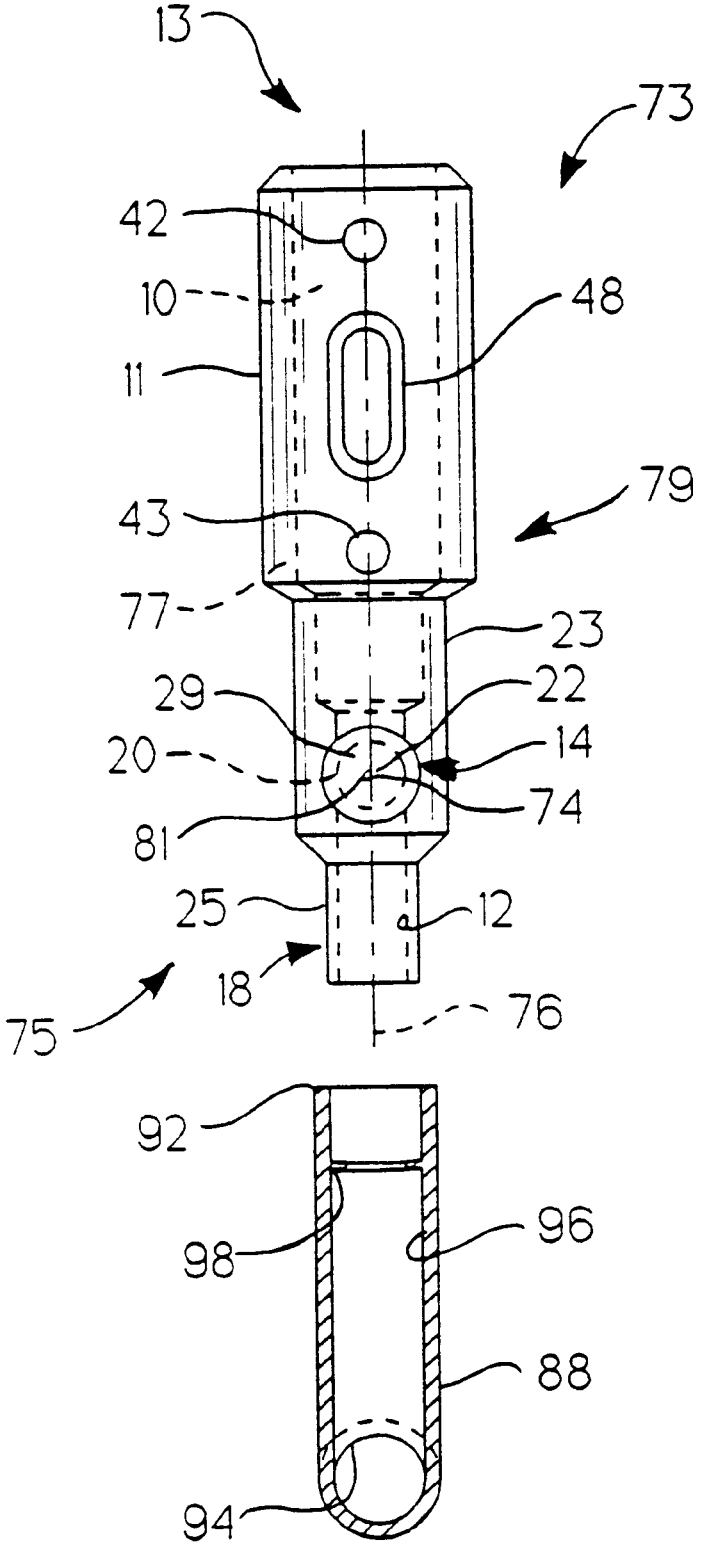
FIG. 5 is a side elevational view of the exhaust control mechanism and muffler of FIG. 3 showing the exhaust collection chamber, throttle passage, and exhaust passage in phantom lines.

Referring to FIGS. 1 and 3–5, muffler 73 includes a chamber body 11. Chamber body 11 includes a cylindrical side wall 60 and an end cap 50 which cooperate to define an exhaust collection chamber 10. Cylindrical side wall 60 is formed to include an exhaust-receiving aperture 48 and chamber body 11 is formed to include an exhaust-discharging aperture 77 as shown in FIGS. 3–5. Exhaust gasses exiting model aircraft engine 21 through engine exhaust port 34 enter exhaust collection chamber 10 through exhaust-receiving aperture 48. In alternative embodiments of the present invention, the model aircraft engine system does not include a muffler.

First tube 18 includes an upper section 23 and a lower section 25. First passage 12 formed in first tube 18 extends along a first passage axis 76 through upper section 23 and lower section 25. First tube 18 is connected to muffler 73 to position an inlet of first passage 12 adjacent to and in communication with exhaust-discharging aperture 11 formed in muffler 73. First passage axis 76 also extends trough exhaust collection chamber 11. Upper portion 23 includes a large diameter upstream section of intersection region 22 and lower portion 25 includes a smaller diameter downstream section of intersection region 22 as shown, for example, in FIGS. 3 and 5.

Exhaust gasses from model aircraft engine 21 are collected within exhaust collection chamber 10 and pass through upper section 23 of first tube 18, intersection region 22, and lower section 25 of first tube 18 before entering the atmosphere out of an outlet or open end 126 formed in first tube 18. Slide valve 16 restricts the amount of exhaust gas flowing through intersection region.22 and out of open end 126 to control the speed and power of model engine 21.

First tube 18 also includes an upper portion 79 that is coupled to a source of exhaust gasses. Upper portion 79 includes muffler 73 and upper section 23. In alternative embodiments of the present invention wherein the model aircraft engine system does not include a muffler, the upper portion of the first tube does not a muffler.

Figure 2:
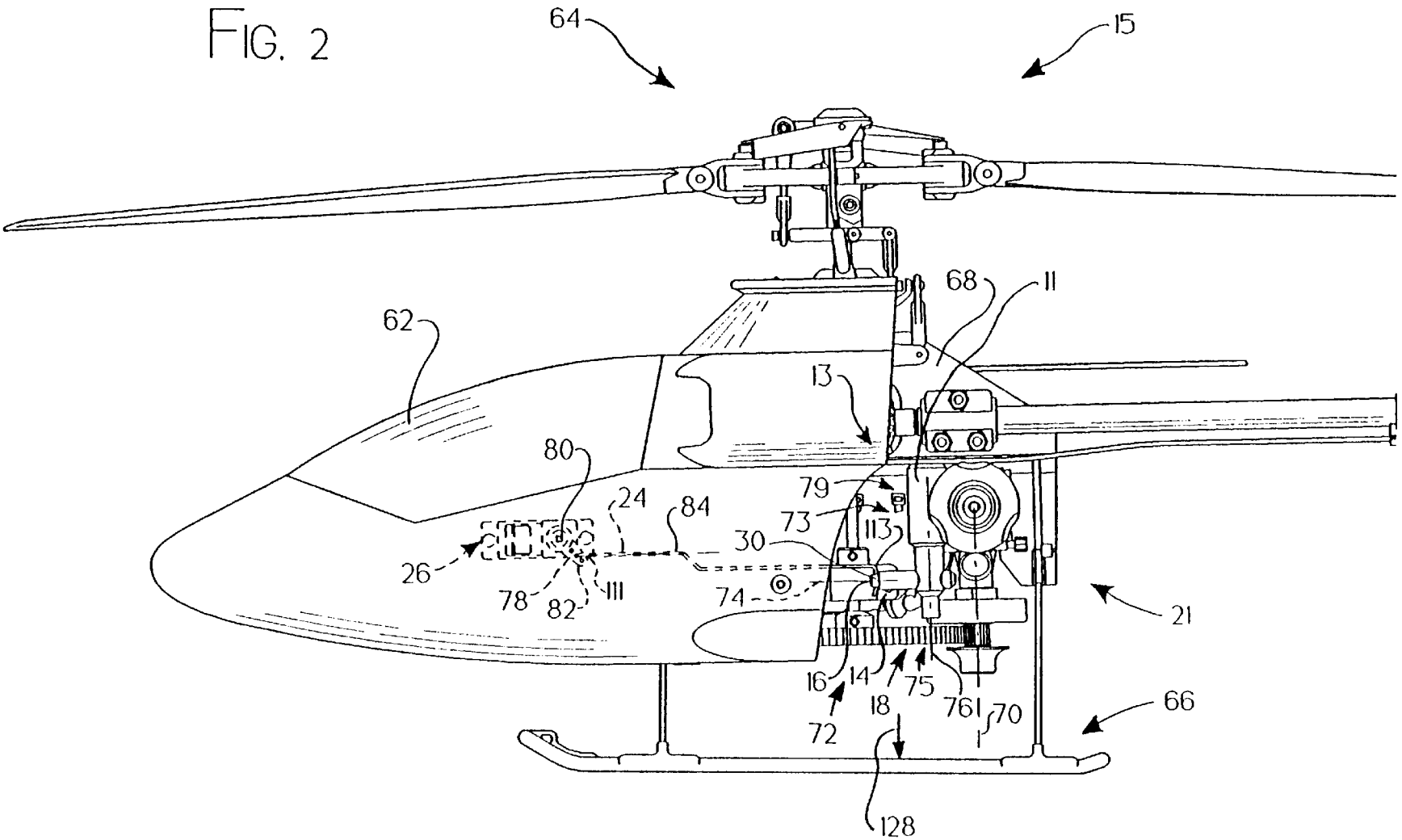
FIG. 2 is a partial side elevational view of a model helicopter including a throttle servo (phantom lines) connected to the throttle of the exhaust control mechanism to control the speed and power of the model aircraft engine.
Figure 8:
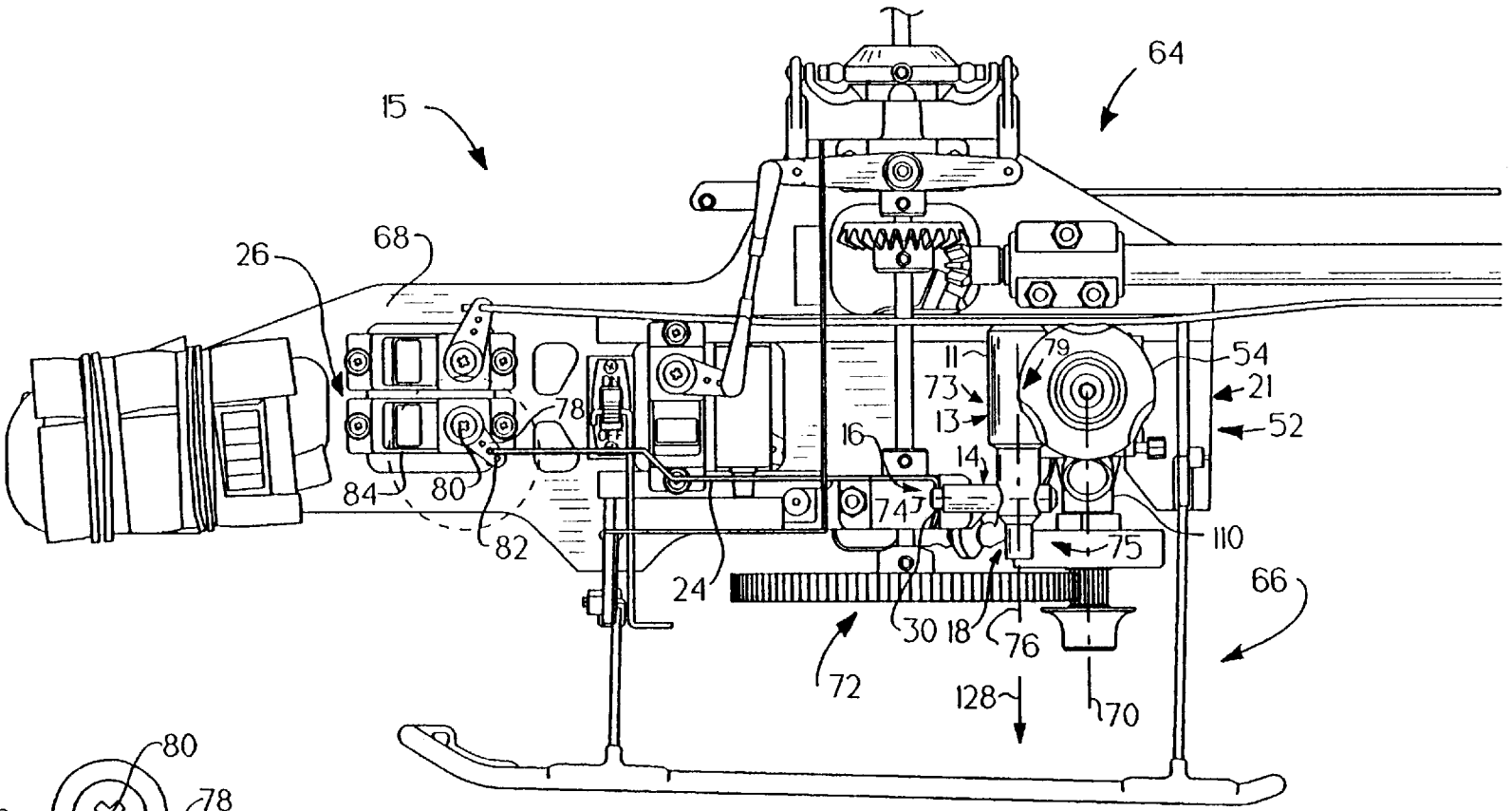
FIG. 8 is a side elevational view of the model helicopter similar to FIG. 2 with the canopy removed showing the throttle servo having a servo arm and a throttle servo pushrod extending between the servo arm of the throttle servo and the slide valve.

First tube 18 is preferably pointed downward in direction 128 away from model aircraft engine 21 along first passage axis 76 so that oily exhaust gasses exhaust downward away from model helicopter 15 as shown in FIGS. 2, 3, and 8. An exhaust extension 88 of some suitable material such as high-temperature silicone tubing is connected to lower section 25 of first tube 18 to carry oily exhaust gasses away from model aircraft engine 21 and model helicopter 15.

Exhaust extension 88 includes a tube-engaging end 92, an outlet end 94 spaced apart from tube-engaging end 92, an inner surface 96, and a tube-positioning ledge 98 connected to inner surface 96. Exhaust extension 88 is connected to first tube 18 by sliding exhaust extension 88 over first tube 18 so tat inner surface 96 of exhaust extension 88 abuts first tube 18. Exhaust extension 88 slides over first tube 18 until tube-positioning ledge 98 abuts first tube 18.

Second tube 14 is coupled to first tube 18 and is arranged, in a preferred embodiment, to lie perpendicular to first tube 18. The second tube 14 includes a generally tubular-shaped inner wall that defines second passage 20. Second tube 14 includes a valve body-receiving left-side portion 27 and a shorter length valve tip-receiving right-side portion 29 as shown, for example, in FIG. 3. Valve body-receiving left-side portion 27 includes an open end 30 to receive slide valve 16 and valve tip-receiving right-side portion 27 includes a closed end 81 so that exhaust gasses do not exit exhaust control mechanism 13 through valve body-receiving left-side portion 27. Valve tip-receiving right side portion 27 includes a first end adjacent to first passage 12 and a second end at closed end 81 that is spaced apart from first passage 12.

Second passage 20 formed in second tube 14 extends along a second passage axis 74. Second passage axis 74 is substantially perpendicular to first passage axis 76 as shown in FIG. 3. First passage 12 and second passage 20 meet at intersection region 22 so that first passage 12, second passage 20, and exhaust collection chamber 11 are in communication with each other.

Exhaust control member body 75 includes first and second tubes 14, 18 that are formed to include first and second passages 12, 20. In alternative embodiments, the exhaust control member body does not need to include first and second tubes as long as first and second passages are formed in the exhaust control member body to permit a valve or other device to be positioned in one of the first and second passages to restrict exhaust gasses flowing through the other of the first and second passages.

Slide valve 16 includes an occluding portion and is slidable within second passage 20 of second tube 14 along second passage axis 74. As slide valve 16 slides within second tube 14, the occluding portion of slide valve 16 can partially close or close intersection region 22 of first and second passages 12, 20. Slide valve 16 has a generally cylindrical shape and includes a central axis that is generally coextensive with second passage axis 74. Slide valve 16 includes an elongated body portion 33 having a cross-hole 28 near one end thereof and an outer surface 35 and a tip 31 connected to an end of elongated body portion 33. Elongated body portion 33 is cylindrical and tip 31 is a frustoconical shape. Tip 31 includes a first side 47 connected to elongated body 33 and a second side 49 spaced apart from first side 47. Second side 49 of tip 31 is positioned to lie closer to second passage axis 74 than first side 47 of second passage axis 74.

Figure 3A:
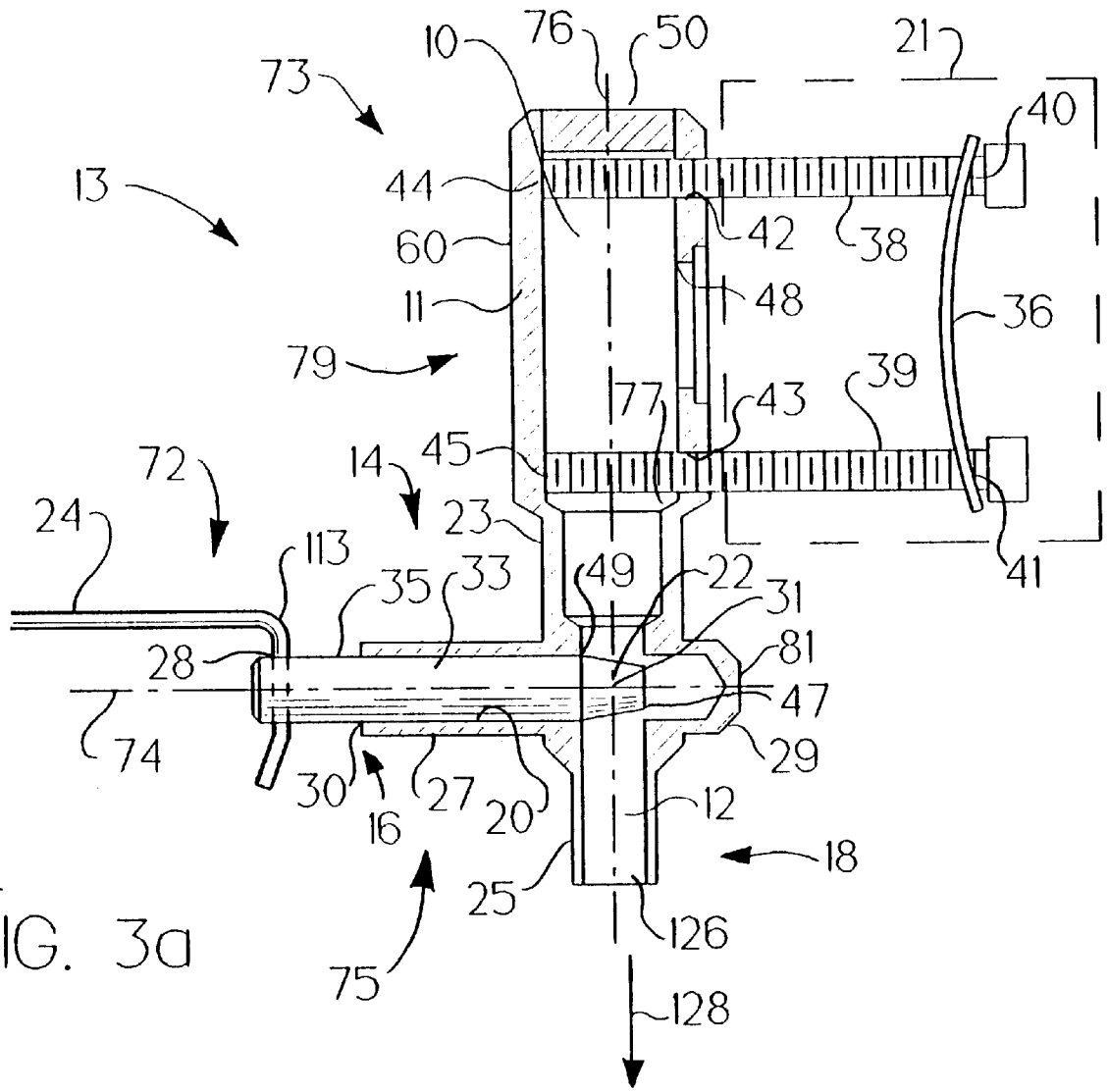
FIG. 3*a* is a cross-sectional view similar to FIG. 3 showing the slide valve positioned to lie in the throttle tube so that a tip of the slide valve is positioned to lie in an intersection region between the throttle passage and exhaust passage to partially close or occlude the intersection region to restrict the flow of exhaust gasses passing through the exhaust tube.
Figure 3B:
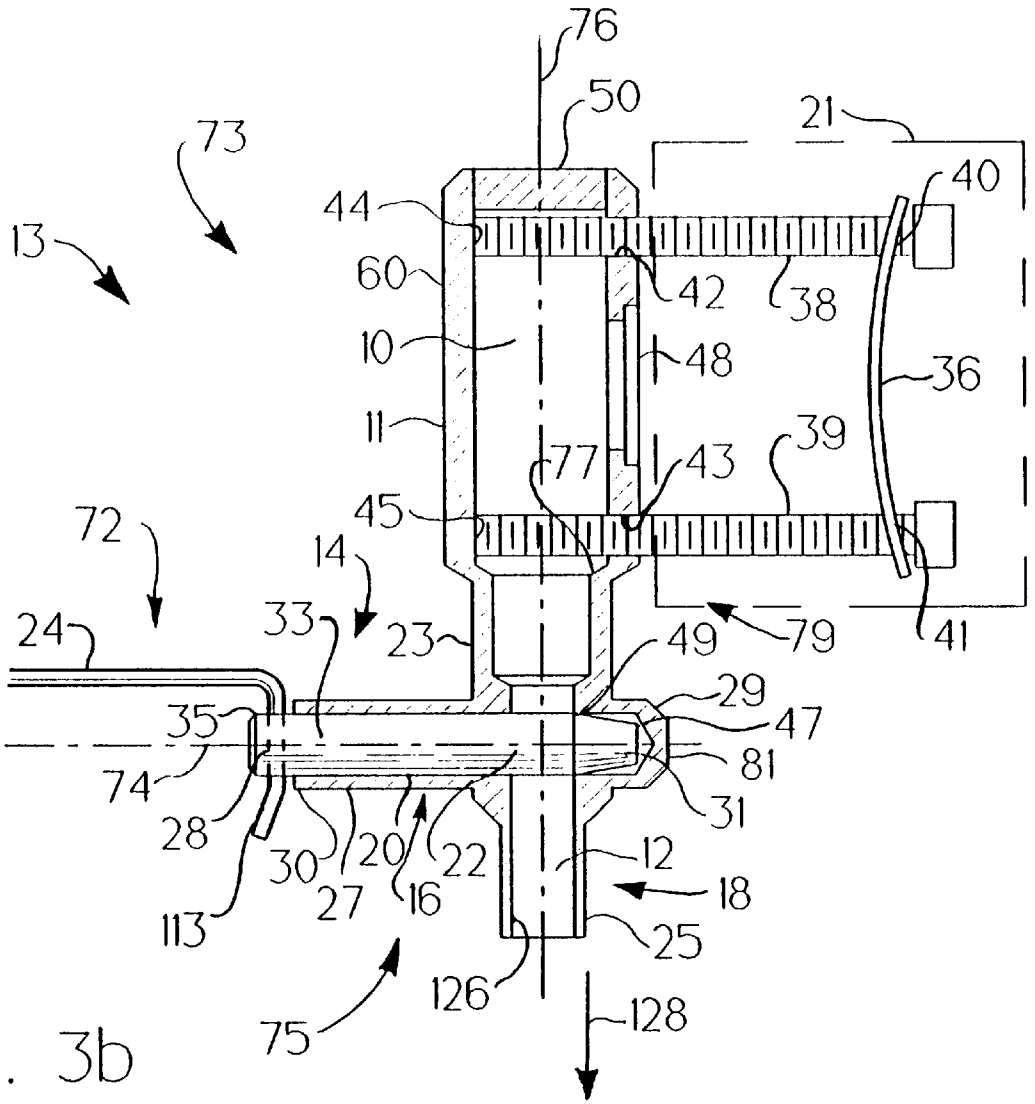
FIG. 3*b* is a cross-sectional view similar to FIGS. 3 and 3*a* showing the slide valve being actuated further into the throttle tube so that the tip of the valve is positioned to lie in a valve tip-receiving portion of throttle tube to fully close or occlude the intersection region between the exhaust passage and throttle passage and prevent the flow of exhaust gasses passing through the exhaust tube.

Tip 31 can be extended into intersection region 22 to partially close or occlude intersection region 22 to restrict the amount of exhaust gasses that can exit model aircraft engine 21 as shown in FIG. 3*a*. Tip 31 can be extended through intersection region 22 into valve tip-receiving portion 29 so that body portion 33 of slide valve 16 is positioned to lie in intersection region 22 to close or occlude more of intersection region 22 or fully close or occlude intersection region 22 to further restrict the amount of exhaust gas that can exit model aircraft engine 2 as shown in FIG. 3*b*. When tip 31 of slide valve 16 is positioned to lie in valve tip-receiving portion 29 of second tube 14, a portion of elongated body portion 33 is positioned to lie in intersection region 22 to block the flow of exhaust gas traveling through intersection region 22. Elongated body portion 33 of slide valve 16 includes a cross-section sized so that slide valve 16 can slide through intersection region 22 and substantially block the flow of exhaust gas when elongated body portion 33 is situated in intersection region 22. Restricting the amount of exhaust gas that can exit model aircraft engine 21 increases the backpressure in model aircraft engine 21 which decreases engine speed and power.

When tip 31 of slide valve 16 is situated in the intersection region 22 or valve tip-receiving portion 29, the flow of exhaust gasses through first passage 12 is restricted to reduce the speed and power of model aircraft engine 21. When tip 31 of slide valve 16 is not situated in intersection region 22 or valve tip-receiving portion 29, model aircraft engine 21 operates at its maximum speed and power because the exhaust gasses flowing from chamber body 11 through exhaust tube 18 are not restricted by slide valve 16.

As shown in FIG. 3, the farther that tip 31 of slide valve 16 is slid along second passage axis 74 in direction 56 into the intersection region 22 and valve tip-receiving portion 29, the lower the speed and power produced by model aircraft engine 21. Conversely, the farther that tip 31 of slide valve 16 is slid along second passage axis 74 in direction 58 out of intersection region 22 and valve tip-receiving portion 29, the higher the speed and power produced by model aircraft engine 21.

Figure 9:
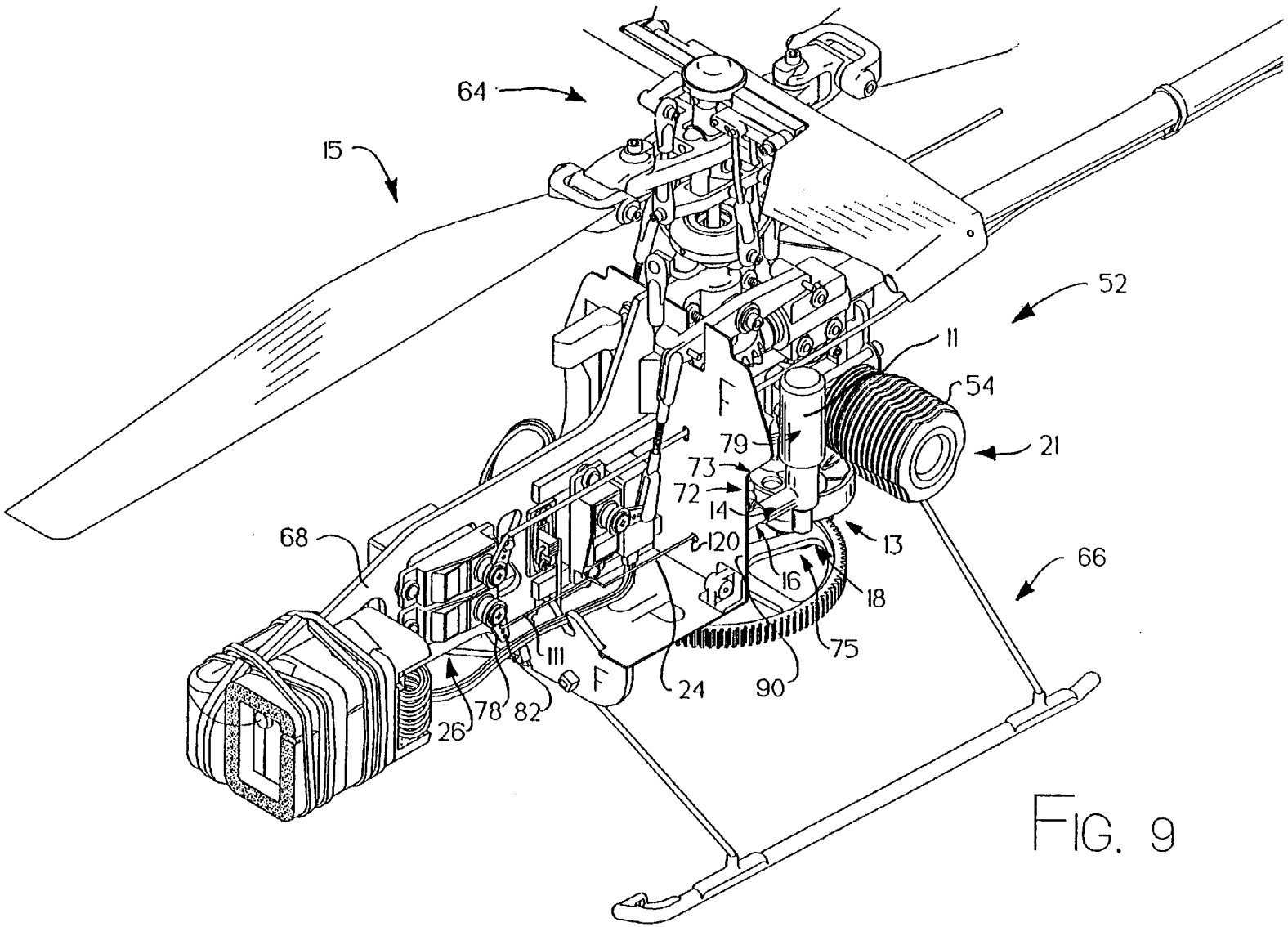
FIG. 9 is a perspective view of the model helicopter showing the model helicopter having a fuselage including a vertically extending elongated keel and a fire wall and the throttle servo pushrod extending through a throttle servo pushrod-receiving aperture formed in the fire wall.

A model helicopter 15 having model aircraft engine 21 and exhaust control mechanism 13 is shown in FIGS. 2, 8, and 9. Model helicopter 15 includes a canopy 62, a main rotor assembly 64, a landing gear assembly 66, and a fuselage 68. The canopy 62, main rotor assembly 64, landing gear assembly 66, and model aircraft engine 21 are connected to fuselage 68. More specifically, model aircraft engine 21 is connected to fuselage 68 in a vertical orientation along a vertical engine axis 70 as shown in FIG. 2. Vertical engine axis 70 is substantially parallel to first passage axis 76 and substantially perpendicular to second passage axis 74.

Exhaust control mechanism 13 further includes a throttle servo 26 connected to fuselage 68 and a throttle pushrod or connector 24. Throttle pushrod 24 includes a first end 111 coupled to throttle servo 26 and a second end 113 coupled to slide valve 16 as shown in FIG. 2. Throttle servo 26 receives an electronic signal sent by an aircraft pilot and changes the position of throttle pushrod 24 of throttle 72 based on the electronic signal. Throttle pushrod 24 extends between throttle servo 26 and slide valve 16 substantially parallel to throttle passage axis 74. Fuselage 68 includes a fire wall 90 that is formed to include a throttle pushrod-receiving aperture 120. Throttle pushrod 24 extends through throttle pushrod-receiving aperture 120 as shown in FIG. 9.

Throttle 72 is a side-actuating throttle 72 as shown in FIG. 1. Open end 30 formed in valve body-receiving left-side portion 27 of throttle tube 14 faces toward pushrod 24 and throttle servo 26 so that pushrod 24 can be connected easily to slide valve 16. Slide valve 16 is formed to include a cross-hole 28 through which second end 113 of pushhrod 24 extends into to connect throttle servo 26 to slide valve 16 as shown in FIGS. 1–3*b* and 8.

Figure 8A:
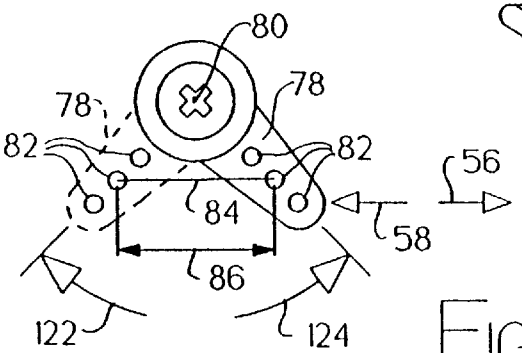
FIG. 8*a* is an enlarged side elevational view of the servo arm situated within the circle of FIG. 8 showing the range of motion of the servo arm.

Throttle servo 26 includes an output arm 78 connected to pushrod 24 at a pushrod-connecting point 82 as shown, for example, in FIGS. 8 and 8*a*. Throttle servo 26 rotates output arm 78 about a throttle servo axis 80 between a slide valve-inserted position (solid line in FIG. 8*a*) and a slide valve-retracted position (phantom line in FIG. 8*a*). The distance that pushrod-connecting point 82 travels along a horizontal control throw axis 84 is called a control throw distance 86 as shown in FIG. 8*a*. Control throw axis 84 is substantially parallel to second passage axis 74 as shown, for example, in FIG. 2. The placement of exhaust control mechanism 13 on model aircraft engine 21 in model helicopter 15 places slide valve 16 in a parallel relationship with horizontal control throw axis 84 of throttle servo 26 so that throttle pushrod 24 does not need a bellcrank (not shown) to connect pushrod 24 and slide valve 16.

A model helicopter pilot operating a radio control system (not shown) sends an electronic signal to throttle servo 26 to actuate pushrod 24 and slide valve 16. When the model helicopter pilot wants the speed and power of model helicopter 15 to increase, the pilot sends an electronic signal to throttle servo 26 to have throttle servo output arm 78 rotate in direction 122 about throttle servo axis 80 to the slide valve-retracted position to pull tip. 31 of slide valve 16 along second passage axis 74 in direction 58 away from closed end 81 of valve tip-receiving portion 29 so that the backpressure on model aircraft engine 21 is decreased. When the model helicopter pilot wants the speed and power of helicopter 15 to decrease, the pilot sends an electronic signal to throttle servo 26 to have throttle servo output arm 78 rotate in direction 124 about throttle servo axis 80 to the slide valve-inserted position to push tip 31 of slide valve 16 along second passage axis 74 in direction 56 toward closed end 81 of valve tip-receiving portion 29 so that the backpressure on model aircraft engine 21 is increased.

Because model aircraft engines can operate with a very small exhaust opening area, throttle response of conventional exhaust restrictor throttles tends to be highly nonlinear or nonproportional with respect to change of throttle valve position. Small increases in exhaust opening area produce large increases in engine speed and power.

Slide valve 16 is configured to provide a substantially linear or proportional response in the change in the speed and power of model aircraft engine 21 as slide valve 16 is moved through intersection region 22. Tip 31 of slide valve 16 is tapered by an angle 32 of about 10 degrees relative to outer surface 35 of elongated body portion 33 as shown in FIG. 3. Tapering tip 31 of slide valve 16 adjusts the rate that exhaust gasses pass or leak by slide valve 16 in intersection region 22. Tapering tip 31 of slide valve 16 makes slide valve 16 act like a needle valve so that the throttle response of model aircraft engine 21 with exhaust control mechanism 13 is more linear than a model aircraft engine with a conventional exhaust restrictor throttle (not shown). The outer surface 35 of the tip 31 is defined by a point moved about and along the axis 74.

To ensure maximum performance of model aircraft engine system 52, exhaust control mechanism 13 should be sealed to prevent exhaust gas leaks. A small leak between engine exhaust port 34 of model aircraft engine 21 and chamber body 11 of muffler 73 of eat control mechanism 13, for instance, has the same effect as opening slide valve 16. A leak between model aircraft engine 21 and the exhaust control mechanism 13 also increases the noise produced by exhaust gasses exiting model aircraft engine 21 and hinders the model helicopter pilot's ability to control model aircraft engine 21 speed and power.

A muffler strap 36 and bolts 38, 39 are provided to hold exhaust control mechanism 13 securely to model aircraft engine 21. Bolts 38, 39 pass through strap holes 40, 41 Conned in muffler strap 36 into threaded holes 42, 43 formed in chamber body 11 and abut inside surfaces 44, 45 of body 11. Muffler strap 36 is curved and made of a springy material such as 304 alloy stainless steel. When installed on model aircraft engine 21, muffler strap 36 is bent almost flat by bolts 38, 39 and applies pressure to engine cylinder 46 of model aircraft engine 21 to hold exhaust-receiving aperture 48 formed in chamber body 11 tightly against engine exhaust port 34 of model aircraft engine 21 insuring a leak-tight fit between engine exhaust port 34 of model aircraft engine 21 and chamber body 11 of muffler 73. The pressure applied by muffler strap 36 against engine cylinder 46 can be adjusted by modifying the free curvature of muffler strap 36 so that installation of exhaust control mechanism 13 does not damage or distort engine cylinder 46 and affect the operation of model aircraft engine 21.

In the embodiment of the present invention discussed above, model aircraft engine 21 is connected to fuselage 68 of model helicopter 15 along vertical engine axis 70. An alternative embodiment of an exhaust control mechanism 121 according to the present invention is provided, as shown in FIG. 6, for use when model aircraft engine 21 is mounted along a horizontal engine axis (not shown) where model aircraft engine 21 is rotated 90 degrees relative to vertical engine axis 70.

Figure 6:
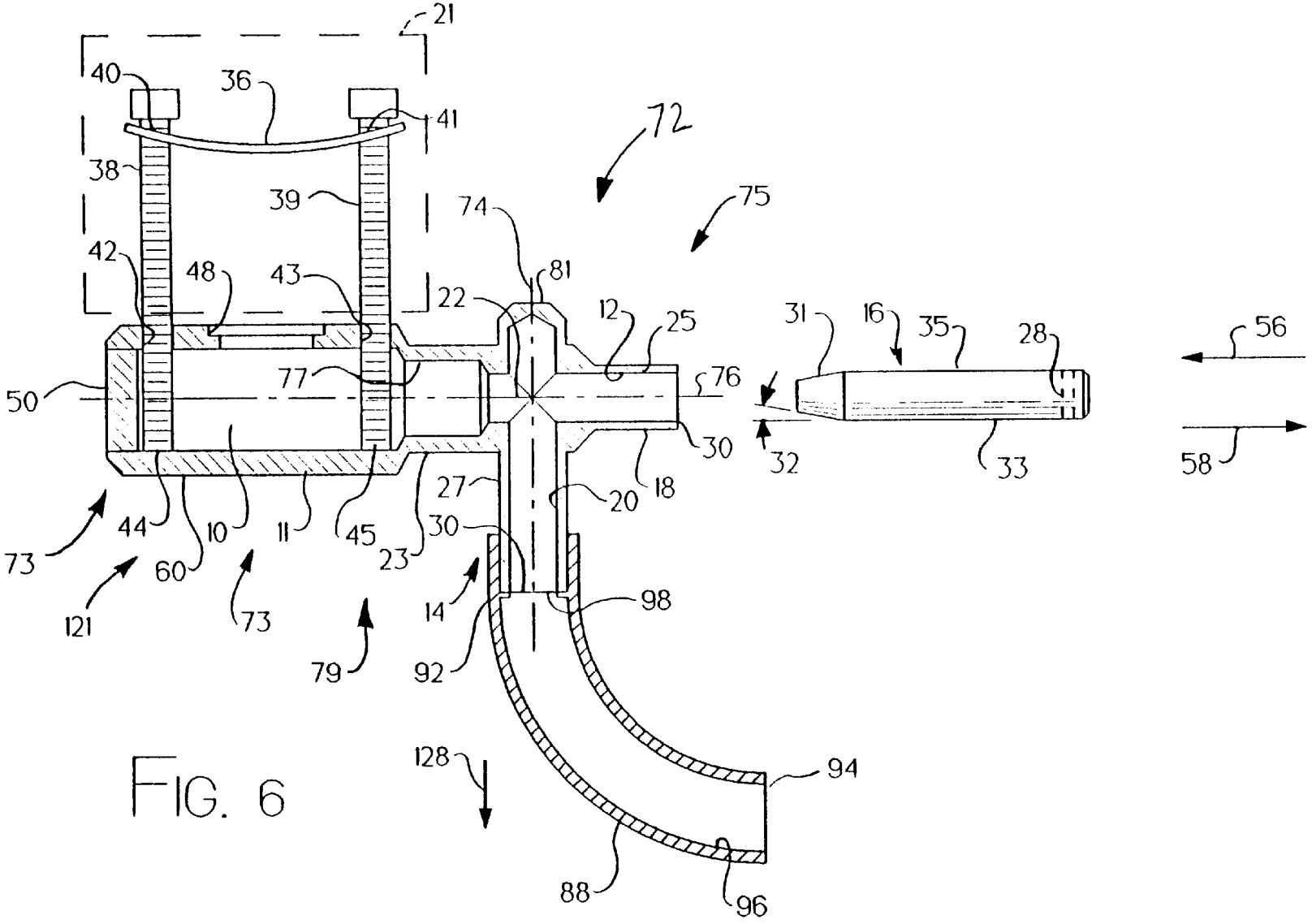
FIG. 6 is a cross-sectional view similar to FIG. 3 of another embodiment of an exhaust control mechanism coupled to a muffler having a chamber body defining an exhaust collection chamber, the exhaust control mechanism including an exhaust control member body having an exhaust tube formed to include an exhaust passage and a throttle tube formed to include a throttle passage extending along a shared axis with the chamber body and a slide valve being sized to slide within the throttle passage.

Exhaust control mechanism 121, shown in FIG. 6, is "repositioned" so that lower portion 25 of first tube 18 faces toward throttle servo 26, throttle pushrod 24, and slide valve 16, Slide valve 16 extends into lower portion 25 of first tube 18 so that valve body-receiving left-side portion 27 of second tube 14 now "acts" as a passage for exhaust gasses to flow through and lower portion 25 of first tube 18 now "acts" as a passage for slide valve 16 to move through. This repositioning of exhaust control mechanism 121 permits slide valve 16 to face toward throttle servo 26 and throttle pushrod 24. Exhaust control mechanism 121 is identical to exhaust control mechanism 13 shown in FIGS. 1–5, 8 and 9.

Slide valve 16 of throttle 72 is situated to slide within first passage 20 in and out of intersection region 22 along first passage axis 76. First passage axis 76 is substantially perpendicular to second passage axis 74 and substantially parallel to horizontal control throw axis 84 of throttle servo 26, shown in FIGS. 2 and 8, so that slide valve 16 is substantially in-line with throttle servo 26.

In both exhaust control mechanisms 13, 121, exhaust gasses flow from exhaust collection chamber 10 through upper section 23 of first tube 18 into intersection region 22. The exhaust gas flow from intersection region 22 to the atmosphere differs for exhaust collection mechanisms 13, 131. In exhaust collection mechanism 13, the exhaust gasses flow from intersection region 22 through lower section 25 of first tube 18 into the atmosphere. In exhaust collection mechanism 121, the exhaust gasses flow from intersection region 22 through left-side portion 27 of second tube 14 into the atmosphere. In exhaust mechanism 121, exhaust extension 88 can be added to second tube 18 to carry oily exhaust gasses away from model aircraft engine 21 and helicopter 15.

Figure 7:
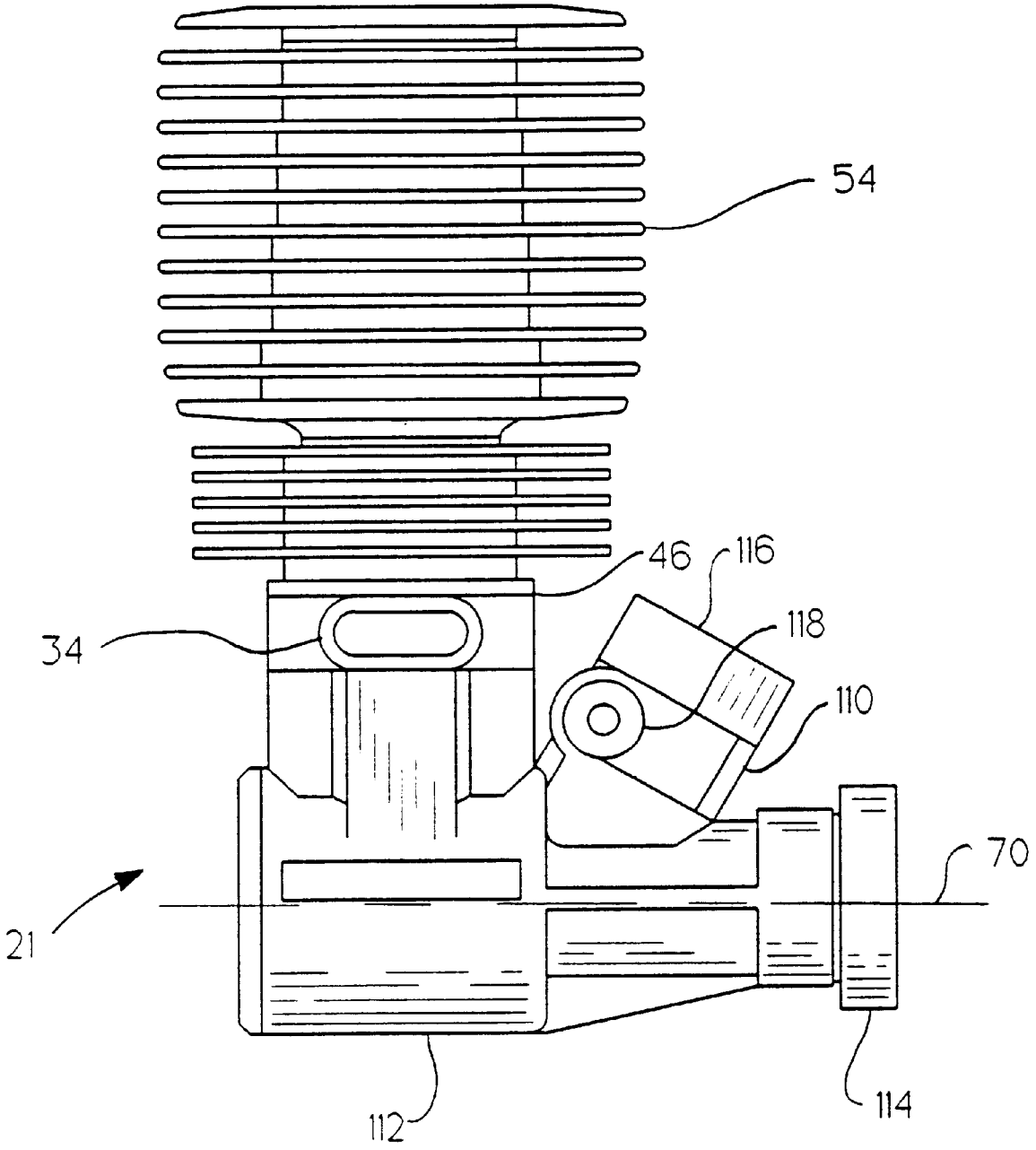
FIG. 7 is a side elevational view of the model aircraft engine of FIG. 1 including a heatsink, carburetor, crankcase, and engine exhaust port.

Exhaust control mechanisms 13, 121 permit slide valve 16 to be situated in a parallel relationship with horizontal control throw axis 84 of throttle servo 26 and thus movement of throttle pushrod 24 whether model aircraft engine 21 is coupled to fuselage 68 along vertical engine axis 70, as shown in FIGS. 2, 7, and 8, or a horizontal engine axis (not shown) where model aircraft engine 21 is rotated 90 degrees relative to vertical engine axis 70. This permits slide valve 16 to always face toward throttle servo 26 and throttle pushrod 24.

Figure 10:
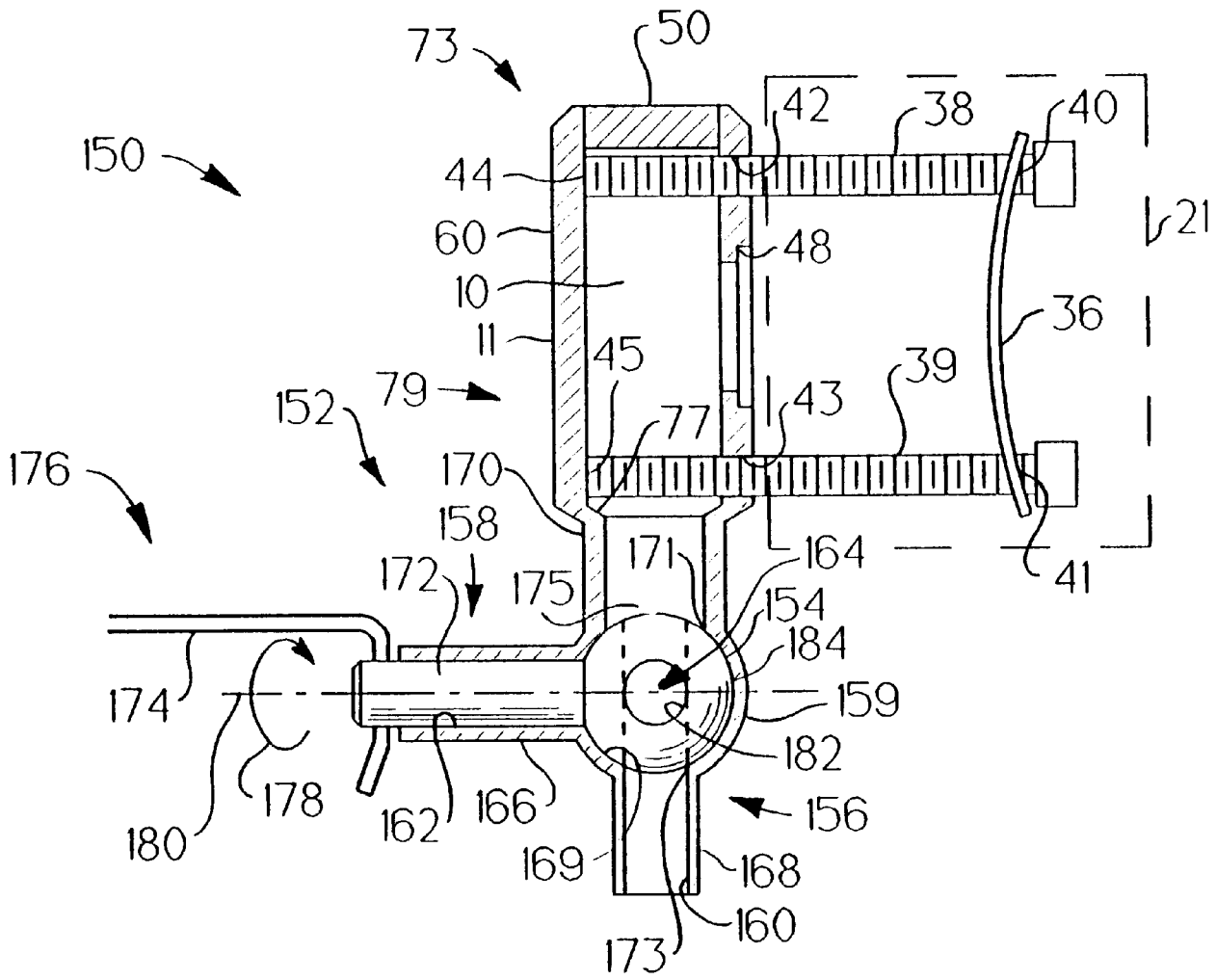
FIG. 10 is a sectional view, similar to FIG. 3, of another embodiment of an exhaust control mechanism having a ball valve positioned to lie in the intersection region between the exhaust passage and throttle passage and actuable to restrict the flow of exhaust gasses passing through the exhaust tube.

Another embodiment of an exhaust control mechanism 150 is shown in FIG. 10. Exhaust control mechanism 150 includes an exhaust control member body 152 and a ball valve 154. Exhaust control member body 152 includes first and second tubes 156, 158 and a ball valve chamber 159. First and second tubes 156, 158 are formed to include first and second passages 160, 162, respectively. First and second tubes 156, 158 intersect at ball valve chamber 159 to define an intersection region 164. First tube 156 includes a valve-actuation member portion 166. Second tube 158 includes a lower section 168 positioned to lie downstream of intersection region 164 and an upper section 170 positioned to lie upstream of intersection region 164. Lower section 168 includes a lower ball valve seat 169 positioned to lie adjacent to interior region 154 and upper section 170 includes an upper ball valve seat 171 positioned to lie adjacent to interior region 154. Lower ball valve seat 169 defines an interior region exhaust-discharging port 173 and upper ball valve seat 171 defines an interior region exhaust-receiving port 175. Exhaust control member body 152 is coupled to muffler 73 as exhaust control member body 75.

Exhaust control mechanism 150 further includes a valve actuator 176 including a valve actuation member 172 and a connector 174 coupled to valve actuation member 172. Valve actuation member 172 is positioned to lie in valve actuation member portion 166 of first tube 156. Connector 174 is configured to rotate valve actuation member 172 and ball valve 154 in direction 178 about an axis 180.

Ball valve 154 is positioned to lie in ball valve chamber 159 to restrict the flow of exhaust gasses passing through intersection region 164 to adjust the speed and power produced by model engine 21. Ball valve 154 includes an outer surface 184 and a passageway 182 through which exhaust gas flows to exit exhaust control mechanism 150. As ball valve 154 is rotated about axis 180, the portion of passageway 182 communicating with upper and lower sections 168, 170 of first tube 156 through interior region exhaust-discharging port 173 and interior region exhaust-receiving port 175, respectively, changes. As the amount of passageway 182 communicating with upper and lower sections 168, 170 changes, the amount of exhaust gasses flowing through passageway 182 changes. If ball valve 154 is positioned so that all of passageway 182 is communicating with upper and lower sections 168, 170, then model engine 21 produces its maximum speed and power because the minimum amount of exhaust gas is being restricted by ball valve 154. If ball valve 154 is positioned to that outer surface 184 of ball valve 154 covers interior region exhaust-discharging port 173 and interior region exhaust-receiving port 175 so that none of passageway 182 communicates with upper and lower sections 168, 170, then no exhaust gasses may flow through exhaust control mechanism 150.

Figure 12:
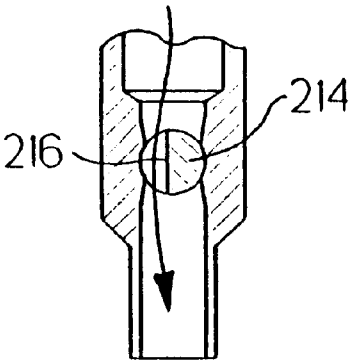
FIG. 12 is a partial sectional view of the cylindrical valve of FIG. 11 in an open position to permit exhaust gasses to flow through intersection region 22.
Figure 11:
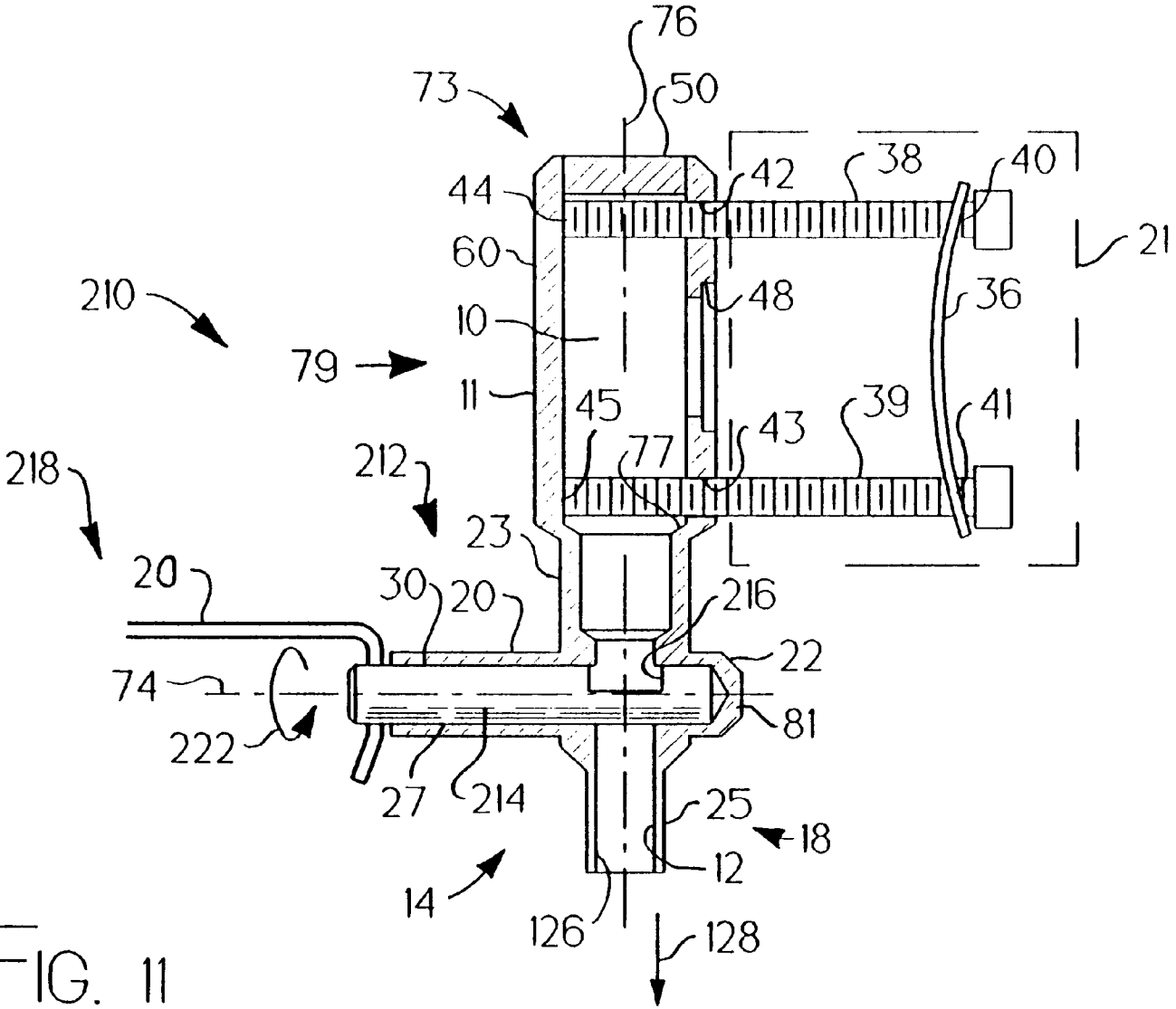
FIG. 11 is a sectional view, similar to FIG. 10, of yet another embodiment of an exhaust control mechanism having a cylindrical valve positioned to lie in the throttle tube and actuable to restrict the flow of exhaust gasses passing through the exhaust tube.

Another embodiment of an exhaust control mechanism 210 is shown in FIGS. 11 and 12. Exhaust control mechanism 210 includes an exhaust control member body 212 that is identical to exhaust control member body 75 of exhaust control mechanism 13 and a cylindrical valve 214. The components of exhaust control member body 212 are identified with the same reference numbers as components of exhaust control member body 75. Cylindrical valve 214 is positioned to lie in second passage 20 formed in second tube 14 to position an opening 216 formed in cylindrical valve 214 within intersection region 22 of first and second passages 12, 20.

Cylindrical valve 214 is actuable to restrict the flow of exhaust gasses passing through first passage 12 to adjust the speed and power produced by model engine 21. Exhaust control mechanism 210 further includes a valve actuator 218 having a connector 220 that rotates cylindrical valve 214 in direction 222 about axis 74. As cylindrical valve 214 is rotated about axis 74, the amount of passageway 216 opening into upper and lower sections 23, 25 changes to restrict varying amounts of exhaust gas flow to adjust the amount of power and speed produced by model engine 21.

In alternative embodiments of exhaust control mechanisms 150, 210, the ball valve or cylindrical valve can be positioned to lie in the first tube and be actuable to restrict the flow of exhaust gasses passing through the second passage.

The number of parts of exhaust control mechanisms 150, 210 are greater than the number of parts of exhaust control mechanism 13 because of ball valve 154 and cylindrical valve 174 used in exhaust control mechanisms 150, 210. In alternative embodiments of the present invention, the slide valve, ball valve, and cylindrical valve may be replaced with other types of valves.

The exhaust control mechanisms 13, 121, 150, 210 of the present invention are simple and inexpensive and provide designers the flexibility to locate model aircraft engine 21 in many different orientations without complicated throttle linkages. The present invention is simpler to build than conventional exhaust restrictor throttles (not shown) which place a valve (not shown) next to the engine exhaust port 34.

All parts of the exhaust control mechanism 13, 150, 210 and muffler 73 are manufacturable on automatic metal turning machines. In a preferred embodiment, chamber body 11 and second tube 14 are made of an aluminum metal material and slide valve 16 is made of brass. First tube 18 is preferably machined separately and press-fit into chamber body 11. End cap 50 is pressed into cylindrical side wall 60 of chamber body 11 to form the end of chamber body 11.

Although this invention has been described in detail with reference to certain embodiments, variations and modifications exist within the scope and spirit of the invention as described and as defined in the following claims.

What is claimed is:

1. An exhaust control mechanism for use in a model engine system having a source of engine exhaust, the exhaust control mechanism comprising an exhaust control member body being formed to include first and second passages, the first passage extends along a first passage axis, the first and second passages intersect at an intersection region, and the exhaust control member is adapted to couple to a source of engine exhaust to position one of the first and second passages in communication with the source of engine exhaust, a valve positioned to lie in the first passage, and a valve actuator being connected to the valve and configured to move substantially along a valve actuator axis to move the valve through the first passage and in and out of the intersection region and the valve actuator axis extending substantially parallel to the first passage axis.

2. The exhaust control mechanism of claim 1, wherein the valve actuator includes a throttle servo having a throttle servo body and an output arm movable relative to the throttle servo body.

3. The exhaust control mechanism of claim 2, wherein the valve actuator further includes a connector having a first end coupled to the output arm of the throttle servo and a second end coupled to the valve.

4. The exhaust control mechanism of claim 2, wherein the valve actuator further includes a connector having a first end coupled to the output arm of the throttle servo and a second end coupled to the valve, the output arm of the throttle servo includes a first end coupled to the servo body and a second end spaced apart from the first end, and the output arm rotates about an axis to move the connector along the valve actuator axis and valve along the first passage axis.

5. The exhaust control mechanism of claim 2, wherein the output arm of the throttle servo is formed to include a plurality of spaced-apart pushrod couplers and the pushrod is coupled to one of the plurality of spaced-apart pushrod couplers.

6. The exhaust control mechanism of claim 5, wherein the spaced-apart pushrod couplers include apertures formed in the output arm.

7. An exhaust control mechanism for use in an engine system having a source of engine exhaust, the exhaust control mechanism comprising an exhaust control member formed to include first and second passages that intersect at an intersection region, the exhaust control member being adapted to couple directly to a source of engine exhaust to position at least one of the first and second passages in communication with the source of engine exhaust, a valve movable in the second passage to extend in and out of the intersection region, and a tubular exhaust extension connected to the first passage.

8. The exhaust control mechanism of claim 7, wherein the first passage includes a muffler formed to include an exhaust-receiving port and an exhaust-discharging port spaced-apart from the exhaust-receiving port, the muffler being adapted to couple to the source of engine exhaust.

9. An exhaust control mechanism for use in an engine system having a source of engine exhaust, the exhaust control mechanism being adapted to receive a flow of engine exhaust from the source of engine exhaust, the exhaust control mechanism comprising an exhaust control member formed to include first and second passages that intersect at an intersection region, the second passage including a valve body-receiving portion and a valve tip-receiving portion, the intersection region being positioned to lie between the valve tip-receiving portion and the valve body-receiving portion, the exhaust control member being adapted to couple to a source of engine exhaust to position the first passage in communication with the source of engine exhaust, and the first passage having an inlet in communication with the source of engine exhaust and an outlet, and a valve including a body and a tip connected to the body, the valve being positioned to lie in the valve body-receiving portion and movable in the second passage to move the tip through the intersection region and in and out of the valve tip-receiving portion, the valve being movable along an axis that is substantially perpendicular to the flow of engine exhaust through the first passage to obstruct the flow of engine exhaust between the inlet and outlet of the first passage, and the valve tip-receiving portion having spaced-apart first and second ends along the axis, the first end of the valve tip-receiving portion being adjacent to the first passage, and the second end of the valve tip-receiving portion being spaced apart from the first passage at the axis.

10. The exhaust control mechanism of claim 9, wherein the valve further includes an outer surface, the valve is movable to move the tip in and out of the intersection region, the valve extends along the axis, the tip of the valve includes a first side connected to the body and a second side spaced apart from the first side, and the outer surface of the second side of the tip is positioned to lie one of closer to and further away from the axis than the outer surface of the first side of the tip.

11. The exhaust control mechanism of claim 10, wherein the tip of the valve is tapered about 10° relative to the outer surface of the body.

12. The exhaust control mechanism of claim 9, wherein the valve includes an occluding portion, the occluding portion includes the tip and a portion of the body, the valve is movable along the axis to move the occluding portion in and out of the intersection region, and the occluding portion includes an outer surface defined by a radial dimension from the axis and the radial dimension varies along the axis.

13. An exhaust control mechanism for use in an engine system having a source of engine exhaust, the exhaust control system being adapted to receive a flow of engine exhaust from the source of engine exhaust, the exhaust control mechanism comprising an exhaust control member formed to include first and second passages that intersect at an intersection region, the exhaust control member being adapted to couple to a source of engine exhaust to position the first passage in communication with the source of engine exhaust, the first passage having an inlet in communication with the source of exhaust and an outlet, and a valve including a body, a tip connected to the body, and an outer surface, the valve being movable in the second passage to move the tip in and out of the intersection region, the valve extending along an axis that is substantially perpendicular to the flow of engine exhaust through the first passage to obstruct the flow of engine exhaust between the inlet and outlet of the first passage, the tip of the valve including a first side connected to the body and a second side spaced apart from the first side, the outer surface of the second side of the tip being positioned to lie one of closer to and further away from the axis than the outer surface of the first side of the tip, and the valve having an outer valve surface defined by a radial dimension from the axis.

14. The exhaust control mechanism of claim 13, wherein the exhaust control member includes a generally tubular-shaped inner wall defining the second passage, the generally cylindrical-shaped inner wall includes a second passage axis, the valve is movable along the second passage axis within the second passage to extend in and out of the intersection region to regulate the flow of exhaust gas in the first passage, and the valve includes a generally cylindrical shape and a central axis generally coextensive with the second passage axis.

15. An exhaust control mechanism for use in an engine system having a source of engine exhaust, the exhaust control mechanism comprising an exhaust control member formed to include first and second passages that intersect at an intersection region, the first passage being substantially perpendicular to the second passage the exhaust control member being adapted to couple to a source of engine exhaust to position of the first passage in communication with the source of engine exhaust, and a valve including a body, a tip connected to the body, and an outer surface, the valve being movable in the second passage to move the tip in and out of the intersection region, the valve extending along an axis, the tip of the valve including a first side connected to the body and a second side spaced apart from the first side, the outer surface of the second side of the tip being defined by a radial dimension from the axis and positioned to lie one of closer to and further away from the axis than the outer surface of the first side of the tip, and the tip of the valve being tapered about 10° relative to the outer surface of the body.

16. An exhaust control mechanism for use in an engine system having a source of engine exhaust, the exhaust control mechanism comprising an exhaust control member formed to include first and second passages that intersect at an intersection region, the first passage including a muffler formed to include an exhaust-receiving port and an exhaust-discharging port spaced-apart from the exhaust-receiving port, the muffler being adapted to couple to the source of engine exhaust, and a valve movable in one of the first and second passages to extend in and out of the intersection region.

17. The exhaust control mechanism of claim 16, wherein the valve includes a body and a tip connected to the body, the valve is movable in the second passage to move the tip through the intersection region and in and out of the valve tip-receiving portion, the body of the valve includes an outer surface, and the tip of the valve is tapered about 10° relative to the outer surface of the body.

18. The exhaust control mechanism of claim 16, wherein the valve includes a body, a tip connected to the body, and an outer surface, the valve is movable to move the tip in and out of tie intersection region, the valve extends along an axis, the tip of the valve includes a first side connected to the body and a second side spaced apart from the first side, and the outer surface of the second side of the tip is positioned to lie one of closer to and further away from the axis than the outer surface of the first side of the tip.

19. The exhaust control mechanism of claim 16, wherein the valve includes an occluding portion, the valve is movable along an axis to move the occluding portion in and out of the intersection region, and the occluding portion includes an outer surface defined by a radial dimension from the axis and the radial dimension varies along the axis.

20. The exhaust control mechanism of claim 16, wherein the valve is a slide valve.

21. The exhaust control mechanism of claim 16, wherein the valve is a slide valve.

22. The exhaust control mechanism of claim 16, further comprising an exhaust extension connected to one of the first and second passages.

23. The exhaust control mechanism of claim 16, wherein the first passage extends along a first passage axis, the exhaust control mechanism further comprises a valve actuator connected to the valve and configured to move substantially along a valve actuator axis to move the valve through the first passage and in and out of the intersection region, and the valve actuator axis extends substantially parallel to the first passage axis.

24. The exhaust control mechanism of claim 23, wherein the valve actuator includes a throttle servo having a throttle servo body and an output arm movable relative to the throttle servo body.

25. The exhaust control mechanism of claim 24, wherein the valve actuator further includes a connector having a first end coupled to the output arm of the throttle servo and a second end coupled to the valve.

26. The exhaust control mechanism of claim 24, wherein the valve actuator further includes a connector having a first end coupled to the output arm of the throttle servo and a second end coupled to the valve, the output arm of the throttle servo includes a first end coupled to the servo body and a second end spaced apart from the first end, and the output arm rotates about an axis to move the connector along the valve actuator axis and valve along the first passage axis.

27. The exhaust control mechanism of claim 16, wherein the exhaust control member includes a generally tubular-shaped inner wall defining the second passage, the generally cylindrical-shaped inner wall includes a second passage axis, the valve is movable along the second passage axis within the second passage to extend in and out of the intersection region to regulate the flow of exhaust gas in the first passage, and the valve includes a generally cylindrical shape and a central axis generally coextensive with the second passage axis.

28. The exhaust control mechanism of claim 16, wherein the muffler includes an outer shell defining an exhaust collection chamber.

29. The model engine system of claim 28, wherein the exhaust collection chamber of the muffler includes a first volume and the intersection region includes a second volume that is less than the first volume.

30. An exhaust control mechanism for use in an engine system having a source of engine exhaust, the exhaust control mechanism comprising an exhaust control member formed to include first and second passages that intersect at an intersection region, the exhaust control member being adapted to couple to a source of engine exhaust to position at least one of the first and second passages in communication with the source of engine exhaust, and a valve including an occluding portion, the valve being movable in one of the first and second passages along an axis to move the occluding portion in and out of the intersection region, and the occluding portion including an outer surface defined by a radial dimension from the axis and the radial dimension varies along the axis.

31. The exhaust control mechanism of claim 30, wherein the exhaust control member includes a generally tubular-shaped inner wall defining the second passage, the generally cylindrical-shaped inner wall includes a second passage axis, the valve is movable along the second passage axis within the second passage to extend in and out of the intersection region to regulate the flow of exhaust gas in the first passage, and the valve includes a generally cylindrical shape and a central axis generally coextensive with the second passage axis.

32. An exhaust control mechanism for use in an engine system having a source of engine exhaust, the exhaust control mechanism comprising an exhaust control member formed to include first and second passages that intersect at an intersection region, the first passage being substantially perpendicular to the second passage the exhaust control member being adapted to couple to a source of engine exhaust to position the first passage in communication with the source of engine exhaust, and a valve movable in the first passage to extend in and out of the intersection region, the valve including means for providing a substantially linear response in the adjustment of power produced by the engine system, the first passage including a muffler formed to include an exhaust-receiving port and an exhaust-discharging port spaced-apart from the exhaust-receiving port, and the muffler being adapted to couple to the source of engine exhaust.

33. The exhaust control mechanism of claim 32, further comprising an exhaust extension connected to one of the first and second passages.

34. An exhaust control mechanism for use in an engine system having a source of engine exhaust, the exhaust control mechanism comprising an exhaust control member formed to include first and second passages that intersect at an intersection region, the first passage being substantially perpendicular to the second passage, the exhaust control member being adapted to couple to a source of engine exhaust to position the first passage in direct communication with the source of engine exhaust, and a slide valve movable in the first passage to extend in and out of the intersection region and one of block the intersection region and divert the flow of exhaust gas from the first passage to the second passage, the first passage including a muffler formed to include an exhaust-receiving port and an exhaust-discharging port spaced-apart from the exhaust-receiving port, and the muffler being adapted to couple to the source of engine exhaust.

35. An exhaust control mechanism for use in an engine system having a source of engine exhaust, the exhaust control mechanism comprising an exhaust control member formed to include first and second passages that intersect at an intersection region, the first passage being substantially perpendicular to the second passage, the exhaust control member being adapted to couple to a source of engine exhaust to position the first passage in direct communication with the source of engine exhaust, and a slide valve movable in the first passage to extend in and out of the intersection region and one of block the intersection region and divert the flow of exhaust gas from the first passage to the second passage, the slide valve including a body and a tip connected to the body, the slide valve being movable in the second passage to move the tip through the intersection region and in and out of the slide valve tip-receiving portion, the body of the valve including an outer surface, and the tip of the slide valve being tapered about 10° relative to the outer surface of the body.

36. An exhaust control mechanism for use in an engine system having a source of engine exhaust, the exhaust control mechanism comprising an exhaust control member formed to include first and second passages that intersect at an intersection region, the first passage being substantially perpendicular to the second passage, the exhaust control member being adapted to couple to a source of engine exhaust to position the first passage in direct communication with the source of engine exhaust, and a slide valve movable in the first passage to extend in and out of the intersection region and one of block the intersection region and divert the flow of exhaust gas from the first passage to the second passage, the slide valve including an occluding portion, the slide valve being movable along an axis to move the occluding portion in and out of the intersection region, and the occluding portion including an outer surface defined by a radial dimension from the axis and the radial dimension varies along the axis.

37. An exhaust control mechanism for use in an engine system having a source of engine exhaust, the exhaust control mechanism being adapted to receive a flow of engine exhaust from the source of engine exhaust, the exhaust control mechanism comprising an exhaust control member formed to include first and second passages that intersect at an intersection region, the exhaust control member being adapted to couple to a source of engine exhaust to position the first passage in communication with the source of engine exhaust, the first passage having an inlet in communication with the source of engine exhaust and an outlet, and the exhaust control member including a generally tubular-shaped inner wall defining the second passage and the generally cylindrical-shaped inner wall having a second passage axis that is substantially perpendicular to the flow of engine exhaust through the first passage, and a slide valve movable along the second passage axis within the second passage to extend in and out ofthe intersection region to obstruct the flow of engine exhaust between the inlet and outlet of the first passage, and the slide valve having a generally cylindrical shape and a central axis generally coextensive with the second passage axis.

38. A method for producing an exhaust control mechanism for use with a model engine, the exhaust control mechanism including first and second tubes formed to include first and second passages, respectively, that intersect at an intersection region and a valve movable in the intersection region to regulate the flow of exhaust gas through the intersection region, the method comprising the steps of providing a first tube manufactured on an automatic turning machine, forming aperture in the first tube, providing a cylindrical-shaped tube that is manufactured on an automatic turning machine, and inserting the second tube into the aperture formed in the first tube.

* * * * *